United States Patent [19]

Rice et al.

[11] Patent Number: 4,869,231

[45] Date of Patent: Sep. 26, 1989

[54] LIFT-UP COOKTOP MOUNTING ARRANGEMENT FOR DOMESTIC RANGE

[75] Inventors: Frank L. Rice; David L. Kinny, both of Louisville, Ky.

[73] Assignee: General Electric Company, Louisville, Ky.

[21] Appl. No.: 292,255

[22] Filed: Jan. 3, 1989

[51] Int. Cl.[4] ..... F24C 5/10

[52] U.S. Cl. ..... 126/214 R; 126/211; 126/39 R; 126/39 B

[58] Field of Search ..... 126/37 A, 37 B, 214 R, 126/211, 39 R, 39 H, 39 B, 39 N, 220; 219/478

[56] References Cited

U.S. PATENT DOCUMENTS 3,004,132 10/1961 Harris et al. ..... 126/214

*Primary Examiner*—Carroll B. Dority, Jr.

*Attorney, Agent, or Firm*—Radford M. Reams; H. Neil Houser

[57] ABSTRACT

An improved cooktop mounting arrangement for a range with an upswept lift-up cooktop including a pair of upper pivot members extending from opposite sides of the upswept section of the cooktop, a pair of spaced lower pivot members extending from opposite sides of the cooktop near the intersection of the upswept section and the cooking surface section, and corresponding upper and lower guides supported from the main range body. The upper and lower guides are cooperatively configured to respectively simultaneously guide the upper pivot members through a vertically oriented arcuate path extending downwardly and forwardly and to guide the lower pivot members through a horizontally oriented path extending generally forwardly and upwardly as the cooktop moves from its lowered position to its raised position. This arrangement eliminates the need for a vertical gap for clearance between the upswept section and overhanging structure when the cooktop is in its lowered position, and also eliminates the need for space behind the upswept section to accommodate rearward movement of the upswept section.

7 Claims, 3 Drawing Sheets

FIG. 1
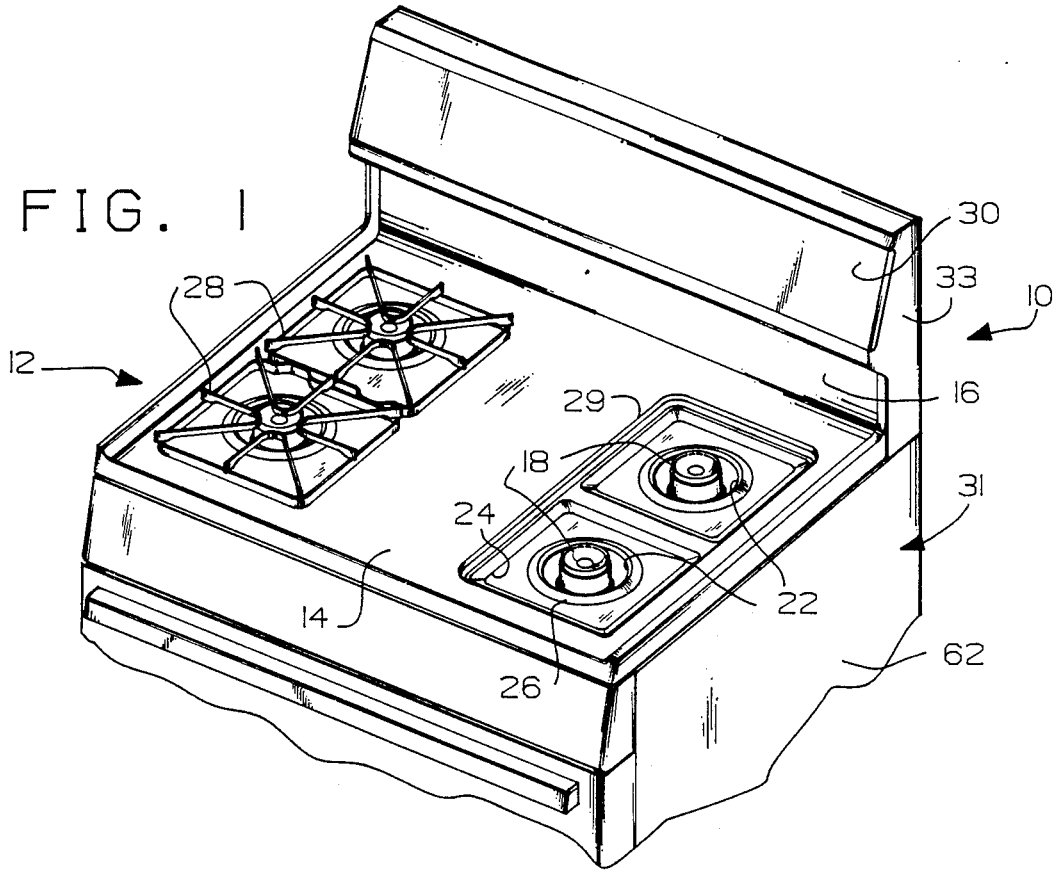
FIG. 7
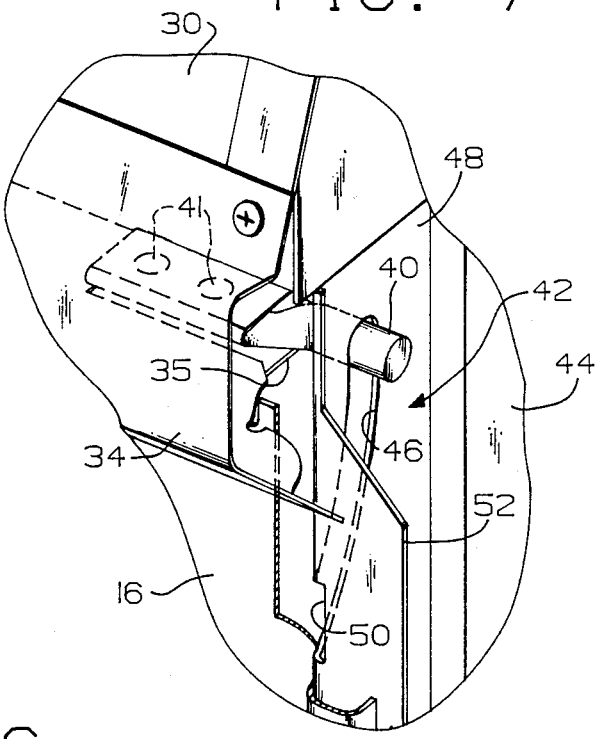
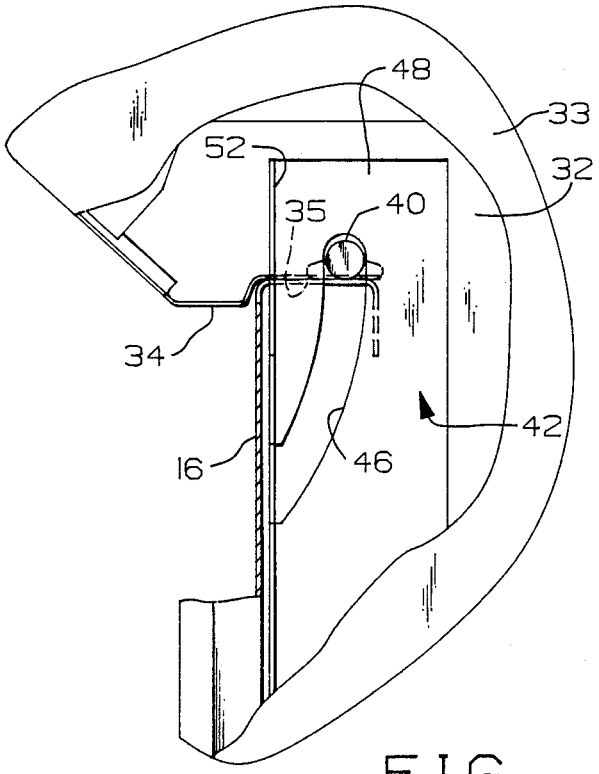
FIG. 6

LIFT-UP COOKTOP MOUNTING ARRANGEMENT FOR DOMESTIC RANGE

BACKGROUND

This invention relates to domestic cooking appliances with lift-up cooktops and more specifically to a mounting arrangement for such lift-up cooktops.

Lift-up cooktops for domestic ranges are well known. Such cooktops are particularly common with gas ranges to permit access to the area beneath the cooktop to clean up spill-overs. Such cooktop may include an integrally formed upswept backsplash section which projects up from the rear of the main cooking surface area of the cooktop. One arrangement known in the art for pivotally mounting the cooktop involves simply providing a fixed pivot or hinge structure at the top edge of the upswept section. Such an arrangement is satisfactory provided a sufficient clearance exists proximate the uppermost extension of the upswept section to permit such pivotal movement. However, it may be desirable from an appearance and convenience standpoint to provide a structure in which the upswept section is set back relative to an overhanging control panel. In such an arrangement a gap between the upswept section and the bottom of the overhanging control compartment would be unsightly.

An alternative known in the art to address this problem involves a fixed pivot point at the intersection of the horizontal and vertical sections of the cooktop. This arrangement is satisfactory, provided there is sufficient clearance behind the upswept section to accommodate rearward tipping of the upswept section as the cooktop is moved to its raised position. However, in the interest of maximizing the area of the horizontal cooking surface, it may be desirable to locate the upswept section such that the space behind this section is insufficient to accommodate the rearward tipping movement of the upswept section.

Therefore, a need exists for an improved mounting arrangement which permits the upper edge of the upswept section to fit closely against any overhanging structure to substantially close off any vertical gaps therebetween when the cooktop is in its lowered position and at the same time not require any space behind the upswept section to accommodate rearward movement of the upswept section.

It is therefore a primary object of the present invention to provide an improved mounting arrangement for lift-up cooktops which requires no gap for vertical clearance between the upper edge of the upswept section of the cooktop and any overhanging structure, and which requires no space behind the upswept section to accommodate rearward movement thereof as the cooktop is moved to its raised position.

It is a further object of the present invention to provide an improved mounting arrangement of the aforementioned type in which the cooktop is easily removable from the range.

SUMMARY OF THE INVENTION

These and other objects of the invention are achieved in accordance with the present invention, by providing in a range of the type having a main body which supports a plurality of heating units, a controls compartment supported above the heating units at the rear of the main body, and a lift-up cooktop generally pivotally movable between a lowered generally horizontal position for cooking and a raised position for access to the area beneath the cooktop, which cooktop includes a cooking surface section with apertures formed therein in register with the heating units to permit the heating units to project upwardly through the apertures when the cooktop is in its lowered position, and an upswept section extending generally upwardly along the rear edge of the cooking surface section, an improved mounting arrangement comprising upper guide means for guidingly supporting the cooktop proximate the upper edge of the upswept section, and spaced lower guide means for guidingly supporting the cooktop near the intersection of the cooking surface and upswept sections, co-operatively configured to respectively simultaneously guide the upper edge of the upswept surface along a vertically oriented path and the intersection of the cooking surface and upswept sections along a vertically oriented path extending forwardly and upwardly as the cooktop is pivotally moved from its lowered position to its raised position. The forward movement of the intersection permits the initial movement of the upswept section to be downward away from any overhanging structure, thereby eliminating the need for any gaps therebetween in its lowered position and also eliminating any need for space behind the upswept section to accommodate rearward movement of the upswept section. The gradual upward movement of the intersection as it moves forward provides sufficient clearance to prevent the cooking surface proximate the apertures for the rear heating units from striking against the heating units.

In a preferred form of the invention the upper and lower guide means respectively comprise a pair of upper pivot members mounted at opposite sides of the cooktop proximate the upper edge of the upswept section and a pair of spaced lower pivot members mounted at opposite sides of the cooktop proximate the intersection of the cooking surface section and the upswept section, and corresponding pairs of upper and lower guide members supported from the main range body adapted to slidingly support the upper and lower pivot members respectively. The upper and lower guide members are cooperatively configured to respectively simultaneously guide the upper pivot members through a vertically oriented arcuate path extending downwardly and forwardly and to guide the lower pivot members through a horizontally oriented path extending generally forwardly and upwardly as the cooktop moves from its lowered position to its raised position.

In accordance with another aspect of the invention the lower guide members are open ended to permit the removal of the cooktop by lateral and rotational movement of the cooktop after raising it slightly beyond its normal raised position. Detent means is provided near the lower end of the upper guide members enabling the upper guide members to releasably retain the upper pivot members, thereby requiring a lateral rotational movement of the cooktop to release the upper pivot members from the upper guide members. This arangement provides for convenient removal of the cooktop for service or cleaning while minimizing the likelihood of unintentional removal.

BRIEF DESCRIPTION OF THE DRAWINGS

FIG. 1 is a front perspective view of the upper portion of a free-standing gas range in which the present invention may be illustratively embodied;

FIG. 6 is an enlarged fragmentary plan view of a portion the range of FIG. 2 with portions removed to illustrate details of the cooktop mounting arrangement;

FIG. 7 is an enlarged fragmentary perspective view of a portion of the mounting arrangement with portions removed to further illustrate details thereof.

DETAILED DESCRIPTION

The embodiment hereinafter described illustrates use of the mounting arrangement of the invention in a gas range. However, it will be appreciated that advantageous use of the invention is not limited to such appliances. For example, such a mounting arrangement could be similarly employed in electric ranges as well.

Figure 2:
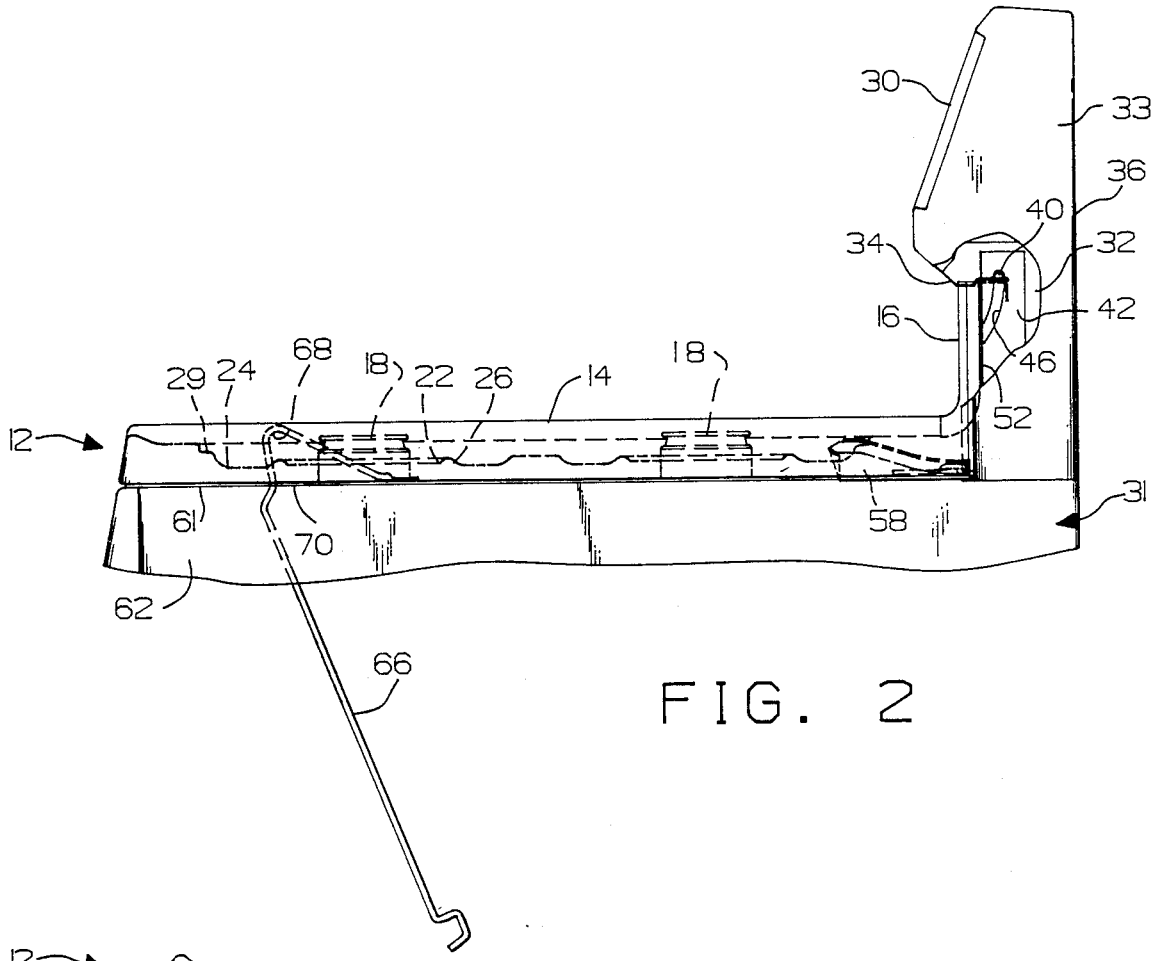
FIG. 2 is a plan view of the range of FIG. 1 with the cooktop in its lowered position and with portions removed to illustrate details of the mounting arrangement.
Figure 3:
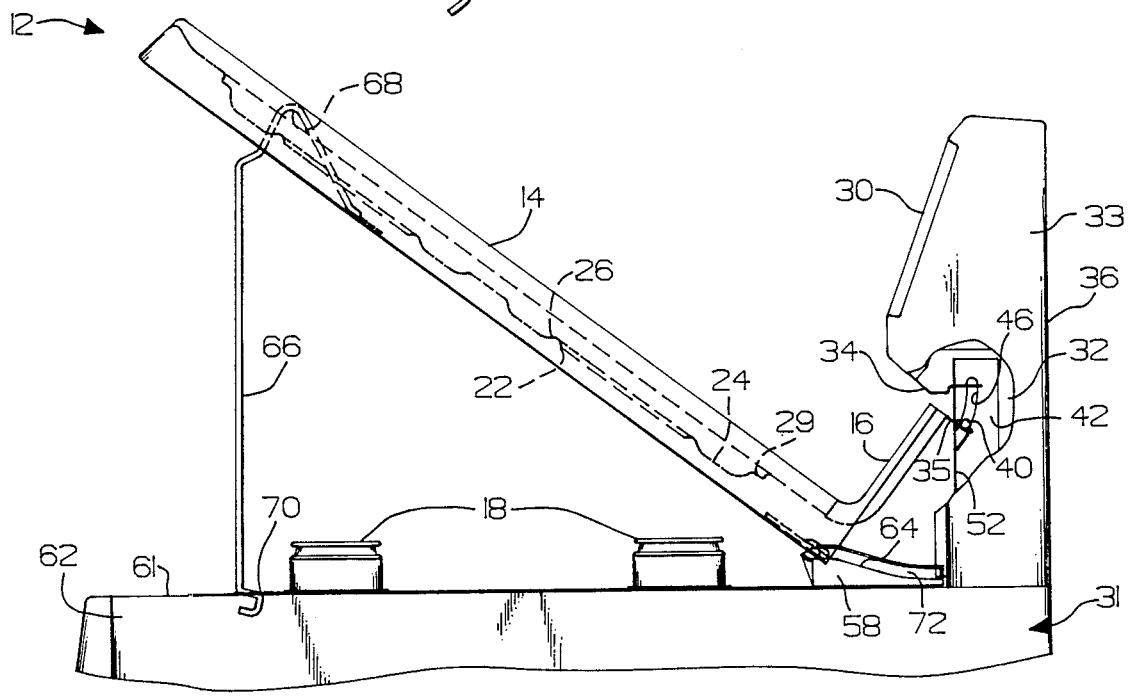
FIG. 3 is a plan view of the range of FIG. 2 with the cooktop moved to its raised position.

Turning now to the drawings and in particular to FIGS. 1–3, there is shown for illustrative purposes, the upper portion of a gas range 10 illustratively embodying the cooktop mounting arrangement of the present invention. Range 10 includes lift-up cooktop member designated generally 12 which is mounted for generally pivotal movement between a lowered position as shown in FIG. 2 and a raised position as shown in FIG. 3. Cooktop 12 is an integrally formed sheet metal part comprising a cooking surface section 14 which is generally horizontal in the lowered position and an upwardly bent upswept section 16 which is generally vertical in the lowered position extending generally upwardly along the rear edge of cooking surface portion 14. Range 10 includes a plurality of heating units comprising gas burners 18, supported from a burner box 20 (shown in part in FIGS. 4 and 5) which extends beneath cooktop 12. Cooking surface section 16 has formed therein a plurality of apertures 22 in register with gas burners 18 to permit the tops of burners 18 to project upwardly through apertures 22 when cooktop 12 is in its lowered position. Each aperture 22 is preferably surrounded by a square depression 24, the annular inner edge of which is provided with an upwardly extending ridge or lip 26. Depression 24 serves to collect spills and boilovers. A removable grate 28 is provided for each burner (two of which are shown in FIG. 1) to support utensils being heated by the burners. The front and rear apertures 22 on each side are surrounded by an outer rectangular depression 29 running front to back, to position grates 28 over burners 20.

A controls compartment fronted by control panel 30 is suitably supported from the main range body 31 by support structure comprising vertical structural member 32 enclosed by end cap member 33, so as to overhang upswept section 16 at the rear area of cooktop 12. Trim piece 34 extends around the lower edge of control panel 30 and rearwardly therefrom, substantially spanning the space between the bottom edge of control panel 30 and flange 35 formed along the top edge of upswept section 16 of cooktop 12 with cooktop 12 in its lowered position. As best seen in FIG. 6, trim piece 34 extends rearwardly overlapping flange 35 of upswept cooktop section 16 such that flange 35 closely approaches trim piece 34 with cooktop 12 in its lowered position. This provides backsplash structure which is essentially continuous in appearance with no unsightly vertical gap between upswept section 16 and the overhanging structure housing the controls compartment.

An exhaust duct for the range oven (not shown) projects upwardly in the area bounded on the front by upswept section 16 when cooktop 12 is in its lowered position and at the rear by rear wall 36 of range 10.

Due to the close lateral proximity of the exhaust duct to upswept cooktop portion 16 when cooktop 12 is in its lowered position, upswept section 16 cannot tip rearwardly into the area behind it. Furthermore, in view of the close proximity of upper edge flange 35 of upswept section 16 to trim piece 34 upswept section 16 must move downwardly away from trim piece 34 as the cooktop swings to its raised position in order to avoid contact with trim piece 34.

Finally, care must be taken in the design of the mounting structure for the cooktop to allow sufficient clearance between the rear edge of apertures 22 surrounding rear burners 18 as cooktop 12 moves to its raised position.

In accordance with the present invention a mounting arrangement for the lift-up cooktop comprises upper guide means for guidingly supporting the cooktop proximate the upper edge of the upswept section, and spaced lower guide means for guidingly supporting the cooktop near the intersection of the cooking surface and upswept sections, co-operatively configured to respectively simultaneously guide the upper edge of the upswept surface along a vertically oriented path and the intersection of the cooking surface and upswept sections along a horizontally oriented path extending forwardly and upwardly as the cooktop is pivotally moved from its lowered position to its raised position. The forward movement of the intersection permits the initial movement of the upswept section to be downward away from any overhanging structure, thereby eliminating the need for any gaps therebetween in its lowered position and also eliminating any need for space behind the upswept section to accommodate rearward movement of the upswept section. The gradual upward movement of the intersection as it moves forward provides sufficient clearance to prevent the cooking surface proximate the apertures for the rear heating units from striking against the heating units.

In a preferred form of the invention the upper and lower guide means respectively comprise pair of upper pivot members and a spaced pair of lower pivot members secured to the cooktop. The pivot members comprising the upper pair are secured to opposite sides of the upswept section of the cooktop proximate the upper edge thereof. The pivot members comprising the lower pair are secured to opposite sides of the cooktop proximate the intersection of the cooking surface and the upswept section. A pair of upper guides for receiving the upper pivot members and a pair of lower guides for receiving the lower pivot members are supported from the main range body. The upper and lower guides are cooperatively configured to simultaneously guide the upper pivot members along a vertically oriented arcuate path downwardly and forwardly away from the controls compartment and to guide the lower pivot members along a generally horizontally oriented path forwardly and upwardly relative to the main range body as the cooktop pivots from its lowered position to its raised position.

While in the description of the illustrative embodiment to follow, the mounting arrangement is shown and described for only one side of the cooktop, it is to be understood that the mounting arrangement is symmetrical and that comparable structure is present to support both sides of the cooktop. Referring again to the drawings, in the illustrative embodiment each of the upper pivot members comprises a pivot pin 40 suitably secured, such as by screws 41, to flange 34 formd along the upper edge of the upswept section 16 of cooktop 12 and projecting laterally outward therefrom. Corresponding upper guide means comprises a channel member 42 of U-shaped cross-section formed integrally with the vertical structural member 32. A vertically oriented arcuate slot 46 extending generally downwardly and forwardly is cut in the bottom wall 48 of channel member 42 to slidably receive upper pivot pin 40 which projects through the slot. By this arrangement slot 46 constrains pivot pin 40 to a gradually upwardly curved path extending downwardly and forwardly.

Detent means for releasably retaining pin 40 in slot 46 is provided in the form of a notch 50 cut in side wall 52 of channel member 42 in alignment with the lower end of slot 46. The depth of notch 50 is less than the distance pivot pin 40 normally projects through slot 46. Thus in normal movement of cooktop 12 to its raised position, pin 40 projects through slot 46 beyond the depth of notch 50 and is retained in slot 46 by abutment with side wall 52 of channel member 42. As will be hereinafter described in greater detail, there is sufficient lateral play between upswept section 16 and vertical structural members 32 when cooktop 12 is raised beyond its normal raised position, to permit removal of the pivot pins from the slots by lateral movement of cooktop 12 to withdraw pivot pin 40 sufficiently to clear channel wall 52 through notch 50.

Figure 4:
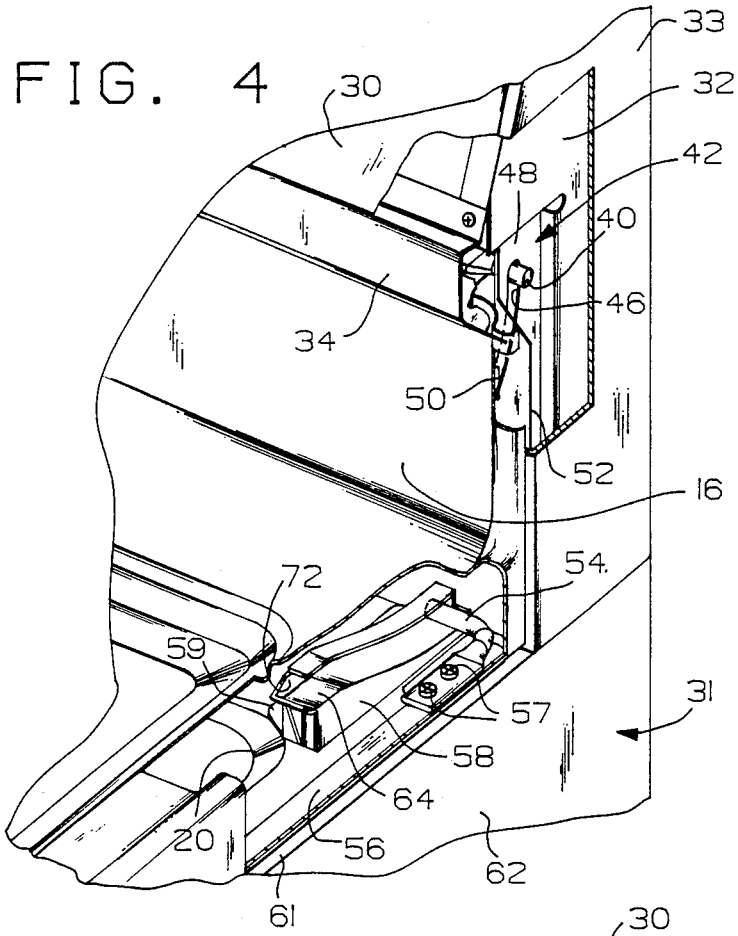
FIG. 4 is an enlarged fragmentary perspective view of the range of FIG. 1 showing the cooktop in its lowered position with portions removed to illustrate details of the mounting arrangement.
Figure 5:
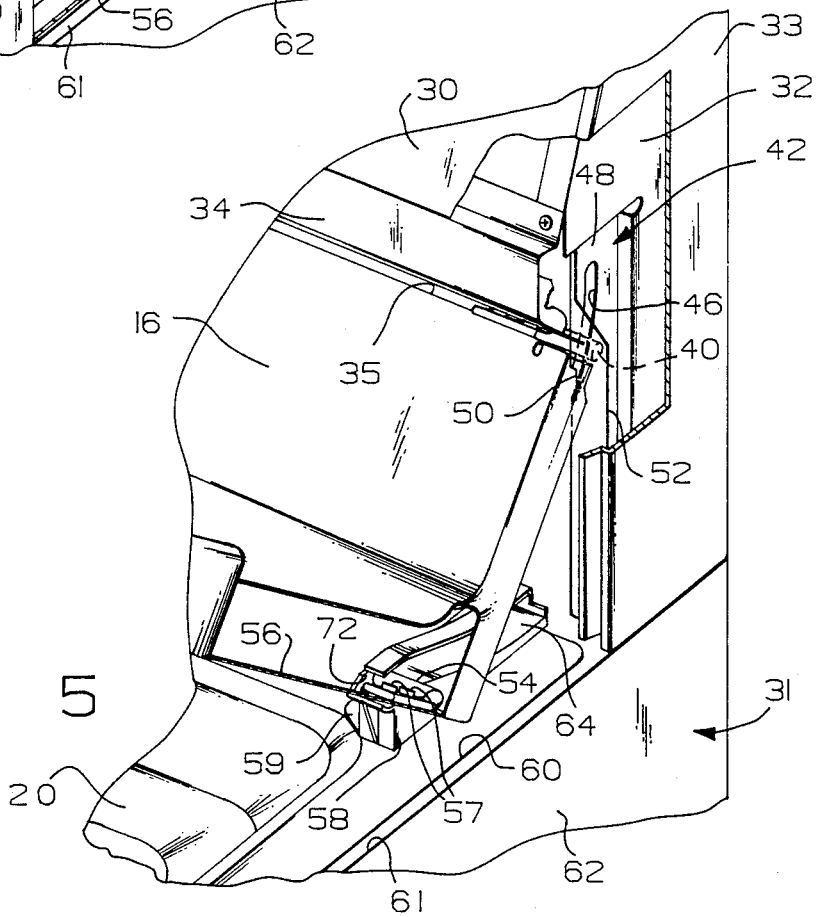
FIG. 5 is an enlarged fragmentary view of the range as in Fig. 4 but with the cooktop in its raised position.

As best seen in FIGS. 4 and 5, the bottom peripheral edge of cooking surface section 14 of cooktop 12 comprises an inwardly extending flange 56 folded beneath the upper surface of cooking surface section 14. Each of the pairs of lower pivot members comprises a pivot pin 54 which is suitably secured, such as by screws 57, to flange 56 proximate the intersection of the cooking surface portion 14 and the upswept portion 16. Pins 54 project inwardly for sliding engagement with the lower guide means.

In the illustrative embodiment each of the lower guides comprises a guide member 58 supported from the main range body 31 proximate its corresponding one of pins 54. Guide member 58 is suitably secured such as by screws (not shown) through flange 59 to outer flange 60 of burner box 20, which overlays flange 61 formed along the upper edge of range side panel 62 of the main range body 31. Each guide member 58 is configured to provide a track section 64 which slidably receives the corresponding lower pivot pin. Guide member 58 is preferably a molded plastic part fabricated from a material having high impact resistance and capable of withstanding temperatures on the order of 400° F., such as Valox #420, readily commercially available from General Electric Company. Track 64 is a side opening, generally horizontally oriented track with a gradually upwardly sloping ramp section contoured to provide to provide sufficient lift as the pivot member moves forward to insure clearance between rear of the burners and the cooking surface, while at the same time providing a primarily horizontal path for the initial movement of pins 54 to permit the upper edge of upswept portion 16 to clear the bottom edge of control panel 30.

Overall, the contours of slot 46 and track 64 are cooperatively configured to permit a smooth generally pivotal movement of the cooktop between its lowered and raised positions while at the same time providing the aforementioned clearances between the upper edge of upswept section 16 and the overhanging structure housing the controls compartment and between the rear burners 18 and the cooking surface proximate thereto.

Support means for holding cooktop 12 in its raised position is provided in the form of two low carbon steel rods 66 mounted proximate the front corners of the cooktop. The bending angle at 68 for rods 66 forwardly biases the rods against the front edge of slots located at 70 formed in flange 61 formed along the top of the range body side panels 62 to receive rods 66. The free end of each of rods 66 is shaped in a forwardly facing square C shape. As the cooktop approaches its raised position, the upper portion of the C is withdrawn from the opening and automatically snaps forward to rest on the top surface of flange 61 at the front edge of slot 70, thereby holding the cooktop in the raised position shown in FIG. 3. The bottom portion of the C prevents movement movement of cooktop 12 substantially beyond is normal raised position by catching the bottom surface of flange 61 at the front edge of slot 70 from below.

Recognizing that it may be desirable from time to time to remove cooktop 12 from range 10 for cleaning or service, the mounting arrangement of the present invention as illustratively embodied herein facilitates such removal, which requires that the upper and lower pivot pins be removed from the corresponding slots and tracks respectively. The forward end of the tracks for the lower pivot pins are open. Thus the lower pins can be readily removed by simply raising the cooktop sufficiently beyond its normal raised position. However, as hereinbefore described, the upper pins are releasably detained by detent means at the lower end of the slots. When moving between the lowered and raised positions, lateral movement of cooktop 12 is constrained by the channel members 42 on one side and the side wall 72 of guide member 58 on the other side. Pivotal movement of cooktop 12 beyond its raised position moves lower pivot pins 54 out the open end of track 60. In this position lateral movement of the cooktop is no longer constrained by lower guide members 58, and either one of the upper pivot pins can be withdrawn from its slot by moving cooktop 12 laterally toward the other upper pivot pin. Sufficient lateral clearance is provided to enable the first pin to now move forwardly through notch 50, in channel member 42 by appropriate rotational movement of cooktop 12. With the cooktop rotated sufficiently to remove the first pin, the remaining pin is simply withdrawn from its slot by lateral movement of cooktop 12 away from the slot retaining the other pin.

While in accordance with the Patent Statutes, a specific embodiment of the present invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A lift-up cooktop mounting arrangemnt for a domestic cooking appliance of the type having a main body which supports a plurality of heating units, and a lift-up cooktop pivotally movable between a generally horizontal lowered position and a raised position and having a cooktop section with apertures formed therein for receiving the heating units which project upwardly therethrough when the cooktop is in its lowered position, and an upswept section extending upwardly along the rear edge of the cooktop surface, said mounting arrangement comprising:

upper guide means for slidingly supporting the upswept section of the cooktop near the upper edge thereof;

spaced lower guide means for slidingly supporting the cooktop near the intersection of the cooktop section and the upswept section;

said upper and lower guide means being cooperatively configured to simultaneously guide the upper edge of the upswept section along a vertically oriented downwardly extending path and the intersection of the cooktop section and the upswept section along a horizontally oriented forwardly and upwardly extending path as the cooktop moves from its lowered to its raised position.

2. A lift-up cooktop mounting arrangement for a domestic cooking appliance of the type having a main body, a plurality of heating units supported thereon, a controls compartment supported from the rear of the main body, and a lift-up cooktop pivotally movable between a lowered generally horizontal position for cooking and a raised position for access to the area beneath the cooktop, the cooktop including a cooking surface section with apertures formed therein for receiving the heating units which project upwardly therethrough when the cooktop is in its lowered position, and an upswept section extending generally upwardly along the rear edge of the cooking surface section, the upper edge of the upswept section closely approaching the controls compartment which overhangs the upswept section when the cooktop is in its lowered position, said mounting arrangement comprising:

a pair of upper pivot members mounted to the cooktop proximate the upper edge of the upswept section;

a pair of spaced lower pivot members mounted to the cooktop proximate the intersection of the cooking surface section and the upswept section;

corresponding pairs of spaced upper and lower guide means supported from the main body;

said upper and lower guide means cooperating to respectively simultaneously guide said upper pivot members through a vertically oriented path extending generally downwardly and forwardly and to guide said lower pivot members along a horizontally oriented path extending generally forwardly and gradually upwardly, as the cooktop moves from its lowered position to its raised position.

3. A lift-up cooktop mounting arrangement for a domestic gas cooking appliance of the type having a main body which supports a plurality of gas burners from the top thereof and a lift-up cooktop pivotally movable between a lowered position and a raised position, the cooktop having a cooktop section with apertures formed therein for receiving the burners which project upwardly therethrough when the cooktop is in its lowered position, and an upswept section extending along the rear edge of the cooktop section and extending upwardly therefrom, said mounting arrangement comprising:

an upper pivot member mounted at each side of the upswept section of the cooktop;

a lower pivot member mounted at each side of the cooktop near the intersection of the cooktop section and the upswept section;

upper guide means supported from the main body for receiving said upper pivot members;

lower guide means supported from the main range body for receiving said lower pivot members;

said upper and lower guide means cooperatively configured to respectively simultaneously guide said upper pivot members along a vertically oriented path extending downwardly and forwardly and guide said lower pivot members through a generally horizontally oriented path extending forwardly and upwardly as the cooktop moves from its lowered to its raised position;

whereby the cooktop follows a path which permits the edges of the apertures to clear the burners as the upswept section moves downwardly and the cooktop section moves forwardly and upwardly in moving from its lowered to its raised position.

4. The mounting arrangement of claim 3 wherein said upper guide means defines an arcuate vertically oriented slot extending downwardly and forwardly, and including detent means formed near the lower end thereof for releasably retaining said upper pivot member, and wherein said lower guide means defines an upwardly sloping track for receiving said lower pivot member, said track being open at the forward end thereof, said detent means permitting the removal of the cooktop by lateral and rotational movement of the cooktop in its raised position.

5. A domestic kitchen range comprising:

a main range body;

a support structure extending upwardly from the rear of said main range body for supporting a control compartment;

a lift-up cooktop member movable between a lowered position and a raised position, said cooktop member including a cooking section which overlies said main range body in its lowered position and an upswept section which extends upwardly from said cooking section along the rear edge thereof;

said control compartment overhanging said upswept section when said cooktop is in its lowered position, said upswept section having an upper edge positioned in close proximity to said controls compartment when said cooktop is in its lowered position;

an upper pivot pin projecting laterally from each side of said upswept section proximate said upper edge;

a lower pivot pin projecting laterally from each side of said cooktop member proximate the intersection of said cooking section and said upswept section;

each of said upper pins having corresponding upper guide means supported from said support structure, said upper guide means defining a vertically oriented arcuate slot extending downwardly and forwardly for slidably receiving its corresponding upper pivot pin;

each of said lower pins having corresponding lower guide means supported from said main range body comprising a horizontally oriented track for slidably receiving its corresponding lower pivot pin including a ramp section which extends forwardly and upwardly;

said upper guide slot and said lower guide track being cooperatively contoured to simultaneously guide said upper pivot pins along a downward and forward path and said lower pivot pins along a forward and upward path as said cooktop moves from its lowered to its raised position.

6. A range in accordance with claim 5 further comprising a plurality of gas burners supported from said main range body and wherein said cooking section has formed therein a plurality of apertures, said burners projecting through said apertures when said cooktop is in its lowered position, said ramp portion of said lower guide means being contoured to permit sufficient forward movement of said lower pivot pin, to permit said upper edge of said upswept section to clear said controls compartment and sufficient upward movement to permit said cooking section proximate said burner apertures to clear said burners as said cooktop moves from its lowered to its raised position.

7. A range in accordance with claim 6 wherein said upper guide means further comprises detent means near the forward end thereof for releasably retaining said upper pivot pins, permitting removal of either one of said upper pins from its corresponding slot by lateral and rotational movement of said cooktop when in its raised position.

* * * * *